US012330035B2

(12) United States Patent
Cao et al.

(10) Patent No.: US 12,330,035 B2
(45) Date of Patent: Jun. 17, 2025

(54) HITTING TRAINING DEVICE FOR BASEBALL AND SOFTBALL INDOORS AND OUTDOORS

(71) Applicant: Dongguan Duodian Outdoor Sports Technology Co., Ltd, Guangdong (CN)

(72) Inventors: Chengfei Cao, Guangdong (CN); Jinming Huang, Guangdong (CN)

(73) Assignee: Dongguan Duodian Outdoor Sports Technology Co., Ltd, Dongguan (CN)

( * ) Notice: Subject to any disclaimer, the term of this patent is extended or adjusted under 35 U.S.C. 154(b) by 320 days.

(21) Appl. No.: 18/133,531

(22) Filed: Apr. 12, 2023

(65) Prior Publication Data

US 2024/0342570 A1 Oct. 17, 2024

(51) Int. Cl.
*A63B 69/00* (2006.01)
*A63B 102/18* (2015.01)

(52) U.S. Cl.
CPC ..... *A63B 69/0079* (2013.01); *A63B 69/0002* (2013.01); *A63B 2069/0008* (2013.01); *A63B 2102/18* (2015.10); *A63B 2102/182* (2015.10); *A63B 2225/093* (2013.01)

(58) Field of Classification Search
CPC ..... A63B 69/0079; A63B 69/0002; A63B 2069/0008; A63B 2102/18; A63B 2102/182; A63B 2225/093; A63B 69/0084; A63B 71/023; A63B 2210/50
USPC ..... 473/417, 451, 422–430, 454, 419
See application file for complete search history.

(56) References Cited

U.S. PATENT DOCUMENTS

| | | | | |
|---|---|---|---|---|
| 6,086,488 | A * | 7/2000 | Sanders | A63B 69/0079 473/429 |
| 7,186,193 | B1 * | 3/2007 | McFadden, Jr. | A63B 67/10 473/459 |
| 8,033,934 | B1 * | 10/2011 | Clancy | A63B 43/007 473/422 |
| 10,835,798 | B2 * | 11/2020 | Corniel | A63B 71/023 |
| 11,291,899 | B1 * | 4/2022 | Smith | A63B 69/3623 |
| 11,607,595 | B2 * | 3/2023 | Corniel | A63B 71/023 |
| 2009/0082140 | A1 * | 3/2009 | Liao | A63B 69/0079 473/417 |

* cited by examiner

*Primary Examiner* — Nini F Legesse

(57) ABSTRACT

A hitting training device for baseball and softball indoors and outdoors is disclosed in the utility model, relating to the technical field of training device. The utility model comprises a main pipe, three connecting pipes are uniformly arranged in connection below the main pipe along the circumference; a base pipe is arranged in connection to each of the three connecting pipes; a swivel pipe is arranged in rotatory connection to the inner of the horizontal pipe; a ball mounting pipe is arranged in fixed connection to the swivel pipe; a mounting column is arranged in connection below the ball mounting pipe; a wire rope is arranged in connection below the mounting column; and a ball is arranged in connection below the wire rope. The utility model has a novel structure, reasonable design, adjustable height and better training effect.

8 Claims, 5 Drawing Sheets

HITTING TRAINING DEVICE FOR BASEBALL AND SOFTBALL INDOORS AND OUTDOORS

TECHNICAL FIELD

The utility model relates to the technical field of training device, in particular to a hitting training device for baseball and softball indoors and outdoors.

BACKGROUND TECHNOLOGY

The hitting skill is one of the important skills in baseball and softball. The better the hitting skills, the better the chances of winning baseball and softball games, which requires training on the hitting skills. The hitting training is very difficult, to achieve the object of hitting training, first the importance of hitting training must be realized and the key points and difficulties in hitting skills are mastered, which ensures the quality of hitting skills, and improves the training level of hitting training and the professional quality of athletes.

The hitting training device for baseball and softball is generally composed of base plate, supporting rack and ball fixing column. When using, placing the ball on the ball fixing column, and training through hitting the ball by ball arm; however, the height of the ball according to the height and stance of the user can not be adjusted in using by the traditional training device for baseball and softball, the usage of the training device for baseball and softball is limited. At the same time, when hitting, the ball is easy to be hit on the column of the training device, causing the damage of the ball. After hitting, the ball needs to be found and picked up and recycled manually, which wastes time and energy, affecting the user's exercise experience; thereby, a hitting training device for baseball and softball indoors and outdoors is needed urgently to solve the above problems.

SUMMARY OF THE UTILITY MODEL

The technical problem needs to be solved in the utility model is to overcome the above problems and provide a hitting training device for baseball and softball indoors and outdoors with novel structure, rational design, adjustable height and better training effect.

To solve the above technical problem: the technical schemes provided by the utility model is: a hitting training device for baseball and softball indoors and outdoors, comprising a main pipe, three connecting pipes are uniformly arranged in connection below the main pipe along the circumference; a demountable base pipe is arranged in connection to each of the three connecting pipes; a mounting block is arranged in connection to one end of the base pipe that is remote from the connecting pipe; a U-shaped ground nail is arranged in connection to the mounting block; an inner pipe is arranged in movable connection to the main pipe; a spacing hole one is arranged to the upper part of the main pipe; a spacing bolt one is arranged in connection to the inner of the spacing hole one; a lifting pipe is arranged in movable connection to the upper end of the inner pipe; a spacing hole two is arranged to the lifting pipe; a spacing bolt two is arranged in fixed connection to the inner of the spacing hole; a horizontal pipe is arranged in fixed connection to the lifting pipe; a swivel pipe is arranged in rotatory connection to the inner of the horizontal pipe; a ball mounting pipe is arranged in fixed connection to the swivel pipe; a detachable mounting column is arranged in connection below the ball mounting pipe; a wire rope is arranged in connection below the mounting column; a ball is arranged in connection below the wire rope; a plurality of hangers are arranged in connection to the lifting pipe and the ball mounting pipe; and an elastic rope is arranged in hanging to the hanger.

As an improvement, a spring cotter is arranged in connection below the connecting pipe; a locating hole matched with the spring cotter is provided to the base pipe.

As an improvement, a plug is arranged in connection to the end of the base pipe that is remote from the connecting pipe.

As an improvement, an anti-skid pad is arranged in connection below the mounting block.

As an improvement, both the spacing hole one and the spacing hole two are screwed manually.

As an improvement, a shaft bearing is arranged in connection to the connection between the swivel pipe and the horizontal pipe.

As an improvement, the mounting column and the ball mounting pipe are connected by screw.

As an improvement, a hitch ring is provided to both ends of the elastic rope; a binding ring is arranged in connection to the elastic rope on the hitch ring.

After adopting the above structure, the utility model has the following advantages:

1. the utility model has a novel structure and rational design. Through arranging mounting block and U-shaped ground nail, the U-shaped ground nail can be inserted into the ground when used outdoors, so as the hitting training device for baseball and softball indoors and outdoors can be fixed wholly to be more stable;
2. the inner pipe is fixed by the spacing bolt one and spacing bolt two in the utility model, the whole height of the hitting training device for baseball and softball indoors and outdoors can be adjusted to achieve the object of adjusting the height of the position of the ball according to the height and stance of the user; thereby the hitting training device can be used widely;
3. the upper and lower elastic ropes are arranged in the utility model. After hitting the ball, the ball mounting pipe is driven to rotate, which further rotates the swivel pipe, and the ball mounting pipe pulls the elastic ropes to rotate until the ball stops to rotate under the pulling force of the elastic rope. At this time, through the elastic force of the elastic rope, the ball mounting pipe, elastic rope and ball are pulled back to the original position, which is repeated to reset the ball; whereby, the user can train continuously and the training efficiency and effect are improved;
4. the ball and mounting column are connected with wire rope in the utility model, which ensures the strength, and prevents the user from hitting the ball to the pipe, the service life of hitting training device for baseball and softball indoors and outdoors is prolonged;
5. the ball is designed to be detached by screw in the utility model, it is easy to be replaced after impaired and has better practicability.

DESCRIPTION OF ATTACHED DRAWINGS

The numbers in figure indicate: 1. main pipe; 2. connecting pipe; 3. base pipe; 4. mounting block; 5. U-shaped ground nail; 6. inner pipe; 7. spacing hole one; 8. spacing bolt one; 9. lifting pipe; 10. spacing hole two; 11. spacing bolt two; 12. horizontal pipe; 13. swivel pipe; 14. ball mounting pipe; 15. mounting column; 16. wire rope; 17. ball; 18. hanger; 19. elastic rope; 20. spring cotter; 21. locating hole; 22. plug; 23. anti-skid pad; 24. shaft bearing; 25. hitch ring; 26. binding ring.

SPECIFIC EMBODIMENTS

In the description of the utility model, what should be understood is, such the terms used for indicating direction or position relationship as "up", "down", "front", "rear", "left", "right", "inner", "outer" and "center" are the direction or position relationship based on the attached drawings, which are only used to describe the utility model easily and simplify the description, not to indicate or imply the device or element must be constructed and operated in a specified direction; whereby, those terms can not be understood as the limitation to the utility model.

Further to be stated in the utility model is, unless otherwise expressly stated and qualified, such the terms as "arrange", "mount", "interconnect" and "connect" should be understood broadly, for instance, it can be fixed connection and detachable connection, or integrated connection and mechanical connection, electrical connection, direct connection, indirectly connected through an intermediary, and connection within two components. For ordinary skilled in the field, the specific meaning of the above terms in the utility model can be understood in specific circumstance.

Further detailed description to the utility model is stated in combination with the attached drawings.

Figure 1:
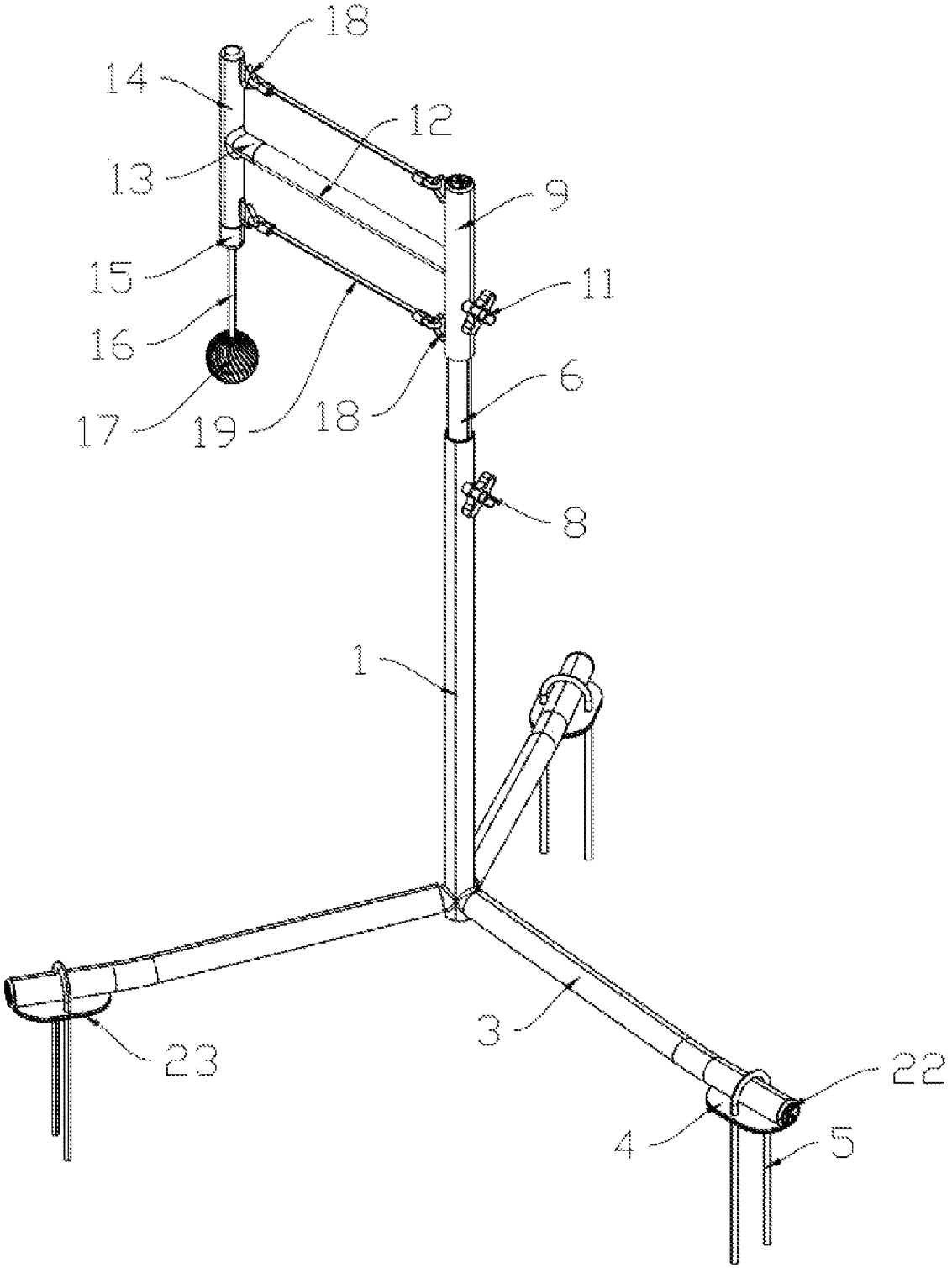
FIG. 1 is a structure diagram of a hitting training device for baseball and softball indoors and outdoors provided in the utility model.
Figure 2:
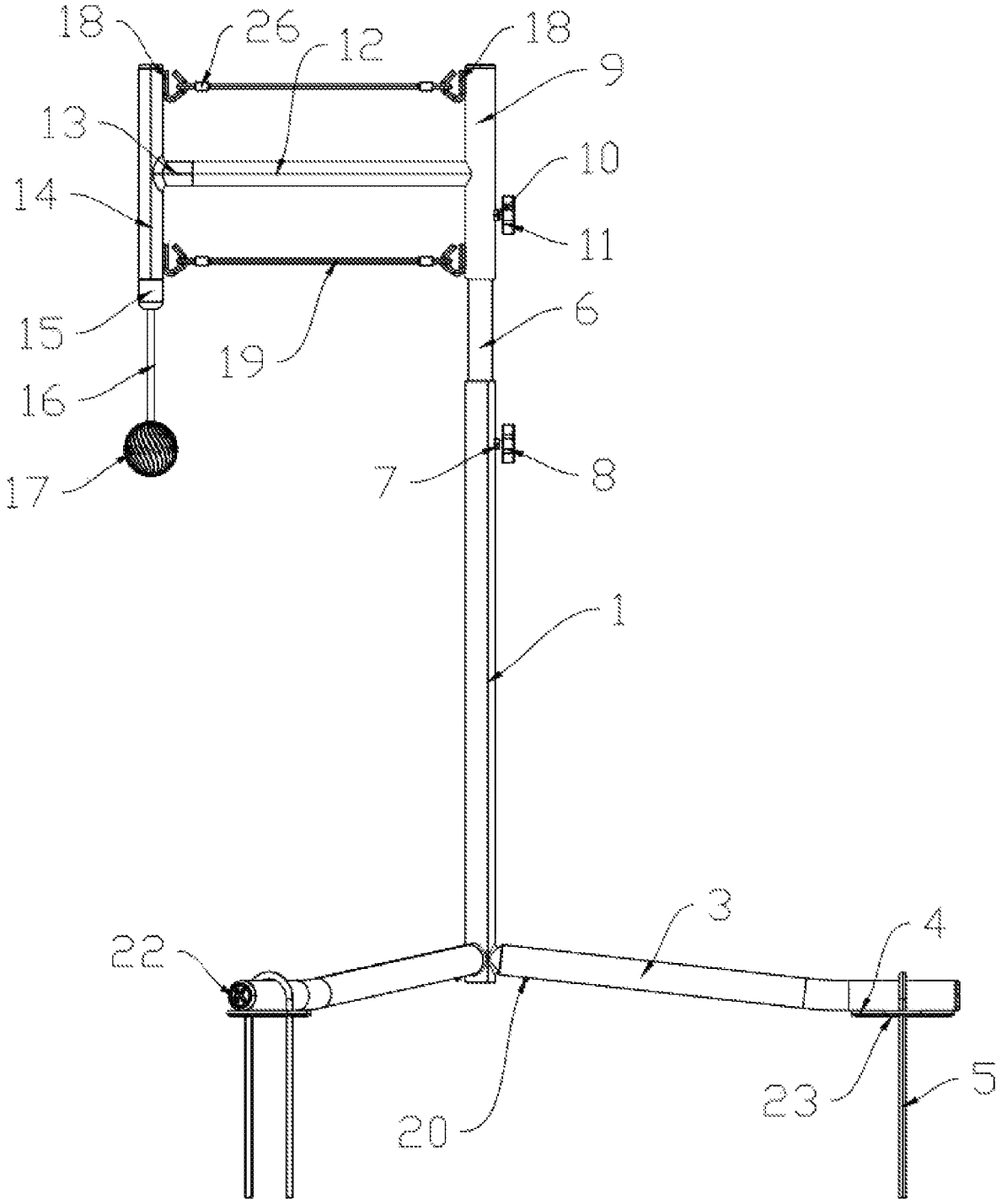
FIG. 2 is a main view of a hitting training device for baseball and softball indoors and outdoors provided in the utility model.
Figure 3:
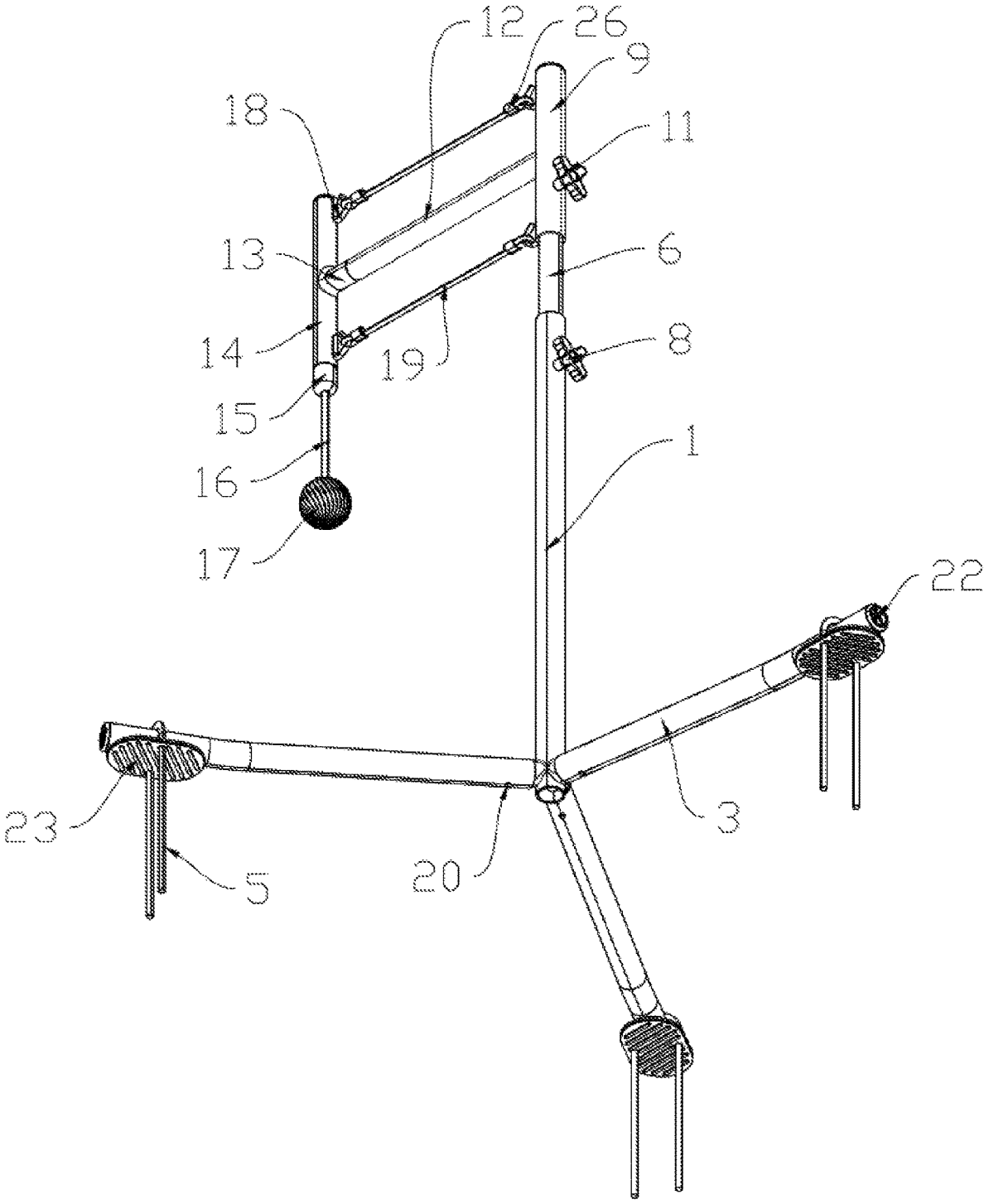
FIG. 3 is an upward view of a hitting training device for baseball and softball indoors and outdoors provided in the utility model.
Figure 4:
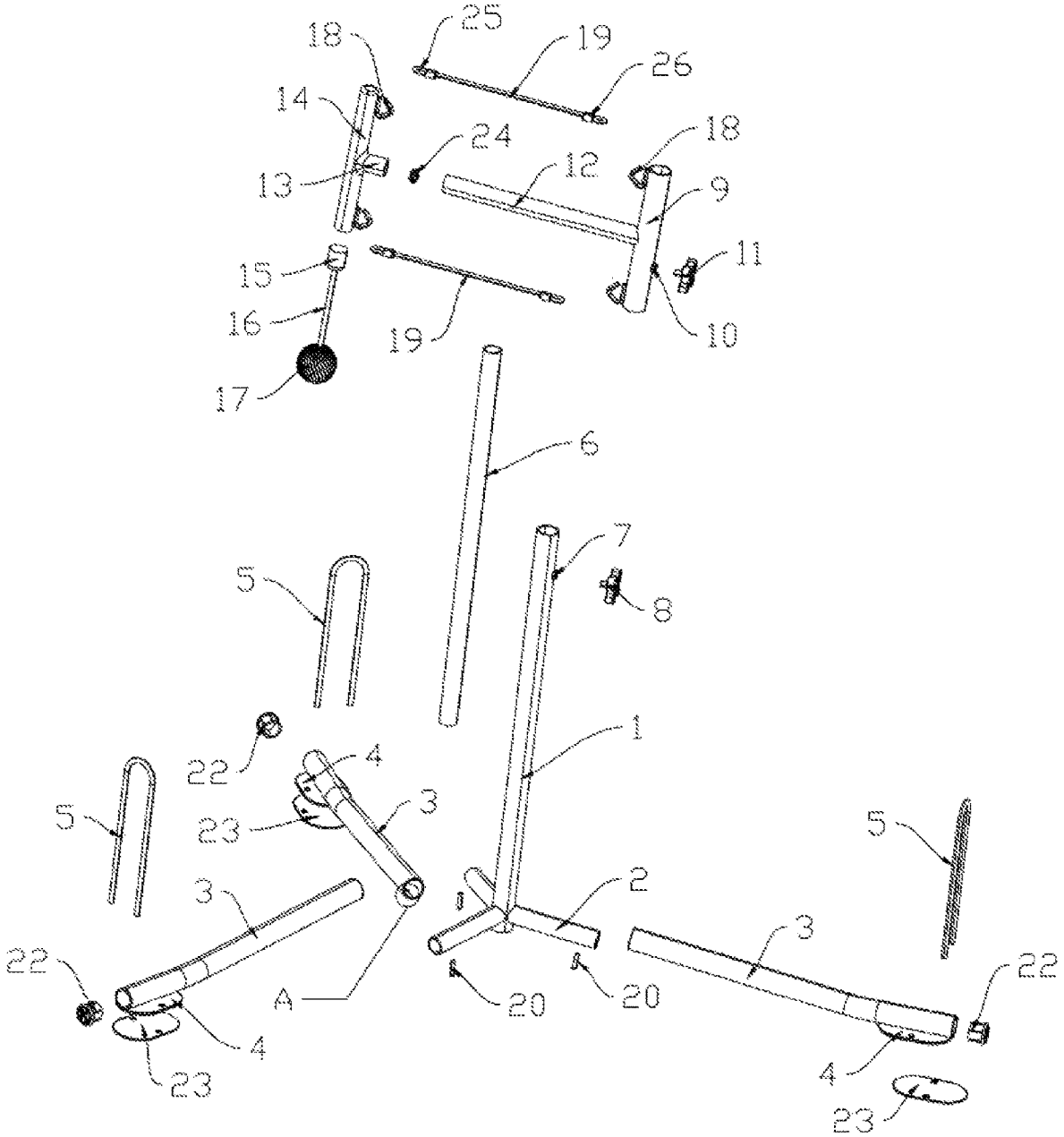
FIG. 4 is an explosive view of a hitting training device for baseball and softball indoors and outdoors provided in the utility model.
Figure 5:
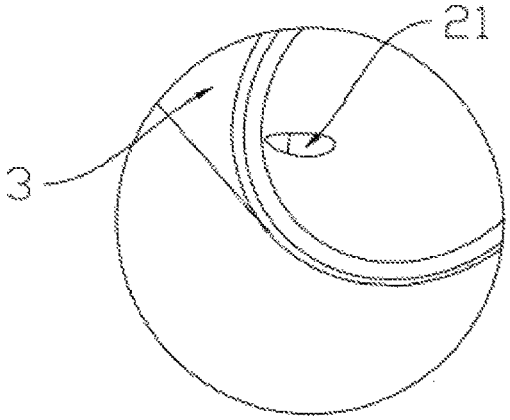
FIG. 5 is a partial enlarged structure of A in FIG. 4.
Figure 6:
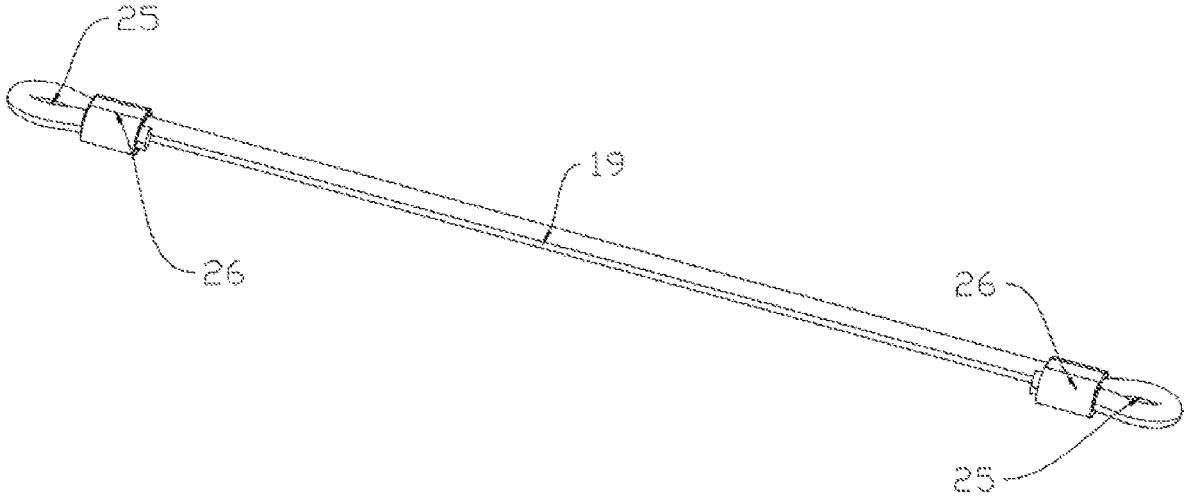
FIG. 6 is a structure diagram of the elastic rope of a hitting training device for baseball and softball indoors and outdoors provided in the utility model.

Referring to FIG. 1-6, a hitting training device for baseball and softball indoors and outdoors, comprising a main pipe 1, and three connecting pipes 2 are uniformly arranged in connection below the main pipe 1 along the circumference; a demountable base pipe 3 is arranged in connection to each of the three connecting pipes 2; a mounting block 4 is arranged in connection to one end of the base pipe 3 that is remote from the connecting pipe 2; a U-shaped ground nail 5 is arranged in connection to the mounting block 4; an inner pipe 6 is arranged in movable connection to the main pipe 1; a spacing hole one 7 is arranged to the upper part of the main pipe 1; a spacing bolt one 8 is arranged in connection to the inner of the spacing hole one 7; a lifting pipe 9 is arranged in movable connection to the upper end of the inner pipe 6; a spacing hole two 10 is arranged to the lifting pipe 9; a spacing bolt two 11 is arranged in fixed connection to the inner of the spacing hole 10; a horizontal pipe 12 is arranged in fixed connection to the lifting pipe 9; a swivel pipe 13 is arranged in rotatory connection to the inner of the horizontal pipe 12; a ball mounting pipe 14 is arranged in fixed connection to the swivel pipe 13; a detachable mounting column 15 is arranged in connection below the ball mounting pipe 14; a wire rope 16 is arranged in connection below the mounting column 15; a ball 17 is arranged in connection below the wire rope 16; a plurality of hangers 18 are arranged in connection to the lifting pipe 9 and the ball mounting pipe 14; an elastic rope 19 is arranged in hanging to the hanger 18; a hitch ring 25 is provided to both ends of the elastic rope 19; and the elastic rope 19 is connected with a binding ring 26 at the hitch ring 25.

In implementing the utility model specifically, the base pipe 3 is mounted to the connecting pipe 2; at this time, the spring cotter 20 is clamped in the locating hole 21. When the hitting training device for baseball and softball indoors and outdoors is used indoors, the mounting hole is reserved in advance, the base pipe 3 is fixed to the specified position with U-shaped ground nail 5. When the hitting training device for baseball and softball indoors and outdoors is used outdoors, the base pipe 3 is fixed with the U-shaped ground nail 5, which is easy to be mounted and is stable. According to the ball 17 needed in training of the user, such as baseball or softball, the proper ball 17 is chose and mounted through the threaded connection between the mounting column 15 and the ball mounting pipe 14. The two elastic ropes 19 are located on the upper and lower sides of the horizontal pipe 12 respectively. When mounting, the ball mounting pipe 14 is parallel with the lifting pipe 9, according to the height and the stance of the user, the height of the inner pipe 6 is adjusted; first loosening the spacing bolt one 8 and adjusting the height of inner pipe 6 relative to main pipe 1 to the proper position; then fastening the spacing bolt one 8 and fixing the inner pipe 6 in the inner of the main pipe 1; if the height is not appropriate, loosening the spacing bolt 11 again and adjusting the height of lifting pipe 9 relative to inner pipe 1 to the proper position; then fastening the spacing bolt two 11 and fixing the lifting pipe 9 in the inner pipe 6; the overall height of the hitting training device for baseball and softball indoors and outdoors can be adjusted when using outdoors. When using, the ball 17 is hit horizontally by the user with a baseball bat or softball bat in hand; after the ball being hit, the ball mounting pipe 14, swivel pipe 13, elastic rope 19 and ball 17 start to rotate around the shaft bearing 24 until the ball 17 stops to rotate under the pulling force of the elastic rope 19. At this time, through the elastic force of the elastic rope 19, the ball mounting pipe 14, elastic rope 19 and ball 17 are pulled back to the original position, which is repeated to reset the ball 17; whereby, the user can train continuously and the training efficiency and effect are improved.

The utility model and embodiments thereof are described above. The description has no restriction on the utility model. What is shown in the attached drawings are only one of the embodiments of the utility model, and the actual structure is not limited to this. In sum, for the ordinary skilled in the field, without departing from the creative purpose of the utility model, the similar structures and examples with the technical scheme designed without creativeness are belong to the protection scope of the utility model.

What is claimed is:

1. A hitting training device for baseball and softball indoors and outdoors, comprising a main pipe (1), characterized by: three connecting pipes (2) are uniformly arranged in connection below the main pipe (1) along the circumference; a demountable base pipe (3) is arranged in connection to each of the three connecting pipes (2); a mounting block (4) is arranged in connection to one end of the base pipe (3) that is remote from the connecting pipe (2); a U-shaped ground nail (5) is arranged in connection to the mounting block (4); an inner pipe (6) is arranged in movable connection to the main pipe (1); a spacing hole one (7) is arranged to the upper part of the main pipe (1); a spacing bolt one (8) is arranged in connection to the inner of the spacing hole one (7); a lifting pipe (9) is arranged in movable connection to the upper end of the inner pipe (6); a spacing hole two (10) is arranged to the lifting pipe (9); a spacing bolt two (11) is arranged in fixed connection to the inner of the spacing hole (10); a horizontal pipe (12) is arranged in fixed connection to the lifting pipe (9); a swivel pipe (13) is arranged in rotatory connection to the inner of the horizontal pipe (12); a ball mounting pipe (14) is arranged in fixed connection to the swivel pipe (13); a detachable mounting column (15) is arranged in connection below the ball mounting pipe (14); a wire rope (16) is arranged in connection below the mounting column (15); a ball (17) is arranged in connection below the wire rope (16); a plurality of hangers (18) are arranged in connection to the lifting pipe (9) and the ball mounting pipe (14); and an elastic rope (19) is arranged in hanging to the hanger (18).

2. A hitting training device for baseball and softball indoors and outdoors of claim 1, characterized by: a spring cotter (20) is arranged in connection below the connecting pipe (2); a locating hole (21) is provided to the base pipe (3); and the spring cotter (20) is matched with the locating hole (21).

3. A hitting training device for baseball and softball indoors and outdoors of claim 1, characterized by: a plug (22) is arranged in connection to one end of the base pipe (3) that is remote from the connecting pipe (2).

4. A hitting training device for baseball and softball indoors and outdoors of claim 1, characterized by: an anti-skid pad (23) is provided below the mounting block (4).

5. A hitting training device for baseball and softball indoors and outdoors of claim 1, characterized by: both the spacing hole one (8) and the spacing hole two (11) are manually screwed.

6. A hitting training device for baseball and softball indoors and outdoors of claim 1, characterized by: a shaft bearing (24) is arranged in connection to the connection between the swivel pipe (13) and the horizontal pipe (12).

7. A hitting training device for baseball and softball indoors and outdoors of claim 1, characterized by: the mounting column (15) and the ball mounting pipe (14) are connected by screw.

8. A hitting training device for baseball and softball indoors and outdoors of claim 1, characterized by: a hitch ring (25) is provided to both ends of the elastic rope (19); and the elastic rope (19) is connected with a binding ring (26) at the hitch ring (25).

* * * * *